US009150346B1

(12) United States Patent
Aramian

(10) Patent No.: US 9,150,346 B1
(45) Date of Patent: Oct. 6, 2015

(54) VITAMIN-DISPENSING MACHINE

(71) Applicant: Arevik V. Aramian, Glendale, CA (US)

(72) Inventor: Arevik V. Aramian, Glendale, CA (US)

( * ) Notice: Subject to any disclaimer, the term of this patent is extended or adjusted under 35 U.S.C. 154(b) by 56 days.

(21) Appl. No.: 13/910,283

(22) Filed: Jun. 5, 2013

(51) Int. Cl.

| | |
|---|---|
| ***G07F 11/16*** | (2006.01) |
| ***B65G 59/00*** | (2006.01) |
| ***B65H 3/00*** | (2006.01) |
| ***B65D 83/04*** | (2006.01) |

(52) U.S. Cl.
CPC ..... *B65D 83/0409* (2013.01)

(58) Field of Classification Search
CPC ..... B65D 83/0409; B65G 59/00; B65H 3/00; G07F 11/16
USPC ..... 221/121, 131, 251, 94, 106, 263, 88, 221/92, 82, 97; 222/135
See application file for complete search history.

(56) References Cited

U.S. PATENT DOCUMENTS

| | | | | |
|---|---|---|---|---|
| 162,613 | A * | 4/1875 | Brear | 417/105 |
| 3,270,915 | A * | 9/1966 | Auer | 221/2 |
| 3,556,342 | A | 1/1971 | Guarr | |
| D289,738 | S | 5/1987 | McLaughlin | |
| 4,775,077 | A | 10/1988 | Capotorto | |
| 4,807,757 | A | 2/1989 | Rappaport | |
| 5,065,905 | A * | 11/1991 | Eddy et al. | 222/132 |
| 5,148,944 | A | 9/1992 | Kaufman | |
| 5,323,929 | A * | 6/1994 | Marlar | 221/3 |
| D363,086 | S | 10/1995 | Vlastuin | |
| 5,568,880 | A * | 10/1996 | DiBartolomeo | 221/131 |
| 5,671,262 | A | 9/1997 | Boyer | |
| 6,085,937 | A * | 7/2000 | Hutchinson et al. | 221/122 |
| 6,168,046 | B1 * | 1/2001 | Galesi | 221/251 |
| 6,427,865 | B1 | 8/2002 | Stillwell | |
| 6,431,399 | B2 * | 8/2002 | Gabel et al. | 221/263 |
| 7,424,960 | B1 * | 9/2008 | Vokac | 221/121 |
| 7,798,362 | B1 * | 9/2010 | Chang | 221/279 |
| 8,727,178 | B1 * | 5/2014 | Carter et al. | 221/6 |
| 2002/0036209 | A1 * | 3/2002 | Chang | 221/121 |

* cited by examiner

*Primary Examiner* — Rakesh Kumar

(57) ABSTRACT

The vitamin dispensing machine is constructed of a canister that is divided into a plurality of individual sections. The canister is transparent and divided into individual sections configured to store a plurality of a certain vitamin or pill-shaped object. The canister includes a snap on lid that has a plurality of snap on caps, which correspond to each of the individual sections in order to refill the respective individual section with the certain vitamin. The canister also includes a plurality of dispense knobs that are able to pull outwardly in order to enable a single vitamin to be dispensed along with other selected sections via a wheel.

10 Claims, 6 Drawing Sheets

VITAMIN-DISPENSING MACHINE

CROSS REFERENCES TO RELATED APPLICATIONS

This non-provisional patent application claims priority to provisional application 61/658,173 filed on Jun. 11, 2012.

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of dispensing machines, more specifically, a machine that is capable of dispensing a plurality of different vitamins.

B. Discussion of the Prior Art

As will be discussed immediately below, no prior art discloses a vitamin dispensing machine that includes a canister that is divided into a plurality of individual sections; wherein the canister is transparent and divided into individual sections configured to store a plurality of a certain vitamin or pill-shaped object; wherein the canister includes a snap on lid that has a plurality of snap on caps, which correspond to each of the individual sections in order to refill the respective individual section with the certain vitamin; wherein the canister also outwardly in order to enable a single vitamin to be dispensed along with other selected sections via a wheel; wherein the wheel rotates a rotating disc that includes a disc hole for each of the individual sections, and upon rotation of the wheel to align the disc hole with the outlet of the dispense knobs, the selected sections are able to dispense a single vitamin simultaneously into a funnel that collects the dispensed vitamins into a pull out drawer; wherein the canister includes a calendar member to keep track of the previous time of use.

The Capotorto Patent (U.S. Pat. No. 4,775,077) discloses a vitamin dispenser designed for home use that may be hung on a wall, and includes a manual release levers for dispensing different types of vitamins when desired. However, the vitamin dispenser is not a transparent canister that includes a plurality of individual sections that are individually drawn from in order to dispense a single vitamin.

The Rappaport et al. Patent (U.S. Pat. No. 4,807,757) discloses a pill dispenser providing sequential dispensing means and automatic incremental dispensing control. However, the pill dispenser does not include a base that enables the machine to lie on a flat surface, and which includes an indexing knob to rotate a canister for dispensing a designated vitmain.

The Kaufman et al. Patent (U.S. Pat. No. 5,148,944) discloses an interactive medication delivery system for individual pills and caplets. However, the delivery system does not include a transparent canister that rotates with respect to a base in order to individually select and dispense a single vitamin from a plurality of different vitamins.

The Boyer Patent (U.S. Pat. No. 5,671,262) discloses a method for counting and dispensing pills, tablets, and capsules. However, the method is not a dispensing machine that can dispense a single vitamin from a plurality of different vitamins.

The Galesi Patent (U.S. Pat. No. 6,168,046) discloses a vitamin and pill dispensing device including a housing having an upper portion, a lower portion of an intermediate portion there between. However, the device is not a canister having a base that enables the device to be placed on a flat surface.

The Guarr Patent (U.S. Pat. No. 3,556,342) discloses an automatic medicine dispensing apparatus. However, the apparatus does not include a transparent canister.

The DiBartolomeo Patent (U.S. Pat. No. 5,568,880) discloses a compartmentalized vitamin dispensing system. Again, the system is not a transparent canister able to rotate above a base.

The Stillwell et al. Patent (U.S. Pat. No. 6,427,865) discloses a device and method for dispensing pills or vitamins. Among other things, the device is not a canister that includes a plurality of individual sections that are vertically aligned, and which include a dispense knob that individually dispenses a single vitamin or pill-shaped object into a drawer located in a base.

The McLaughlin et al. Patent (U.S. Pat. No. Des. 289,738) illustrates an ornamental design for a combined dispensing box for pills and electric alarm.

The Vlastuin Patent (U.S. Pat. No. Des. 363,086) illustrates an ornamental design for a dispenser for candy.

While the above-described devices fulfill their respective and particular objects and requirements, they do not describe a vitamin dispensing machine that includes a canister that is divided into a plurality of individual sections; wherein the canister is transparent and divided into individual sections configured to store a plurality of a certain vitamin or pill-shaped object; wherein the canister includes a snap on lid that has a plurality of snap on caps, which correspond to each of the individual sections in order to refill the respective individual section with the certain vitamin; wherein the canister also includes a plurality of dispense knobs that are able to pull outwardly in order to enable a single vitamin to be dispensed along with other selected sections via a wheel; wherein the wheel rotates a rotating disc that includes a disc hole for each of the individual sections, and upon rotation of the wheel to align the disc hole with the outlet of the dispense knobs, the selected sections are able to dispense a single vitamin simultaneously into a funnel that collects the dispensed vitamins into a pull out drawer; wherein the canister includes a calendar member to keep track of the previous time of use. In this regard, the vitamin dispensing machine departs from the conventional concepts and designs of the prior art.

SUMMARY OF THE INVENTION

The vitamin dispensing machine is constructed of a canister that is divided into a plurality of individual sections. The canister is transparent and divided into individual sections configured to store a plurality of a certain vitamin or pill-shaped object. The canister includes a snap on lid that has a plurality of snap on caps, which correspond to each of the individual sections in order to refill the respective individual section with the certain vitamin. The canister also includes a plurality of dispense knobs that are able to pull outwardly in order to enable a single vitamin to be dispensed along with other selected sections via a wheel. The wheel rotates a rotating disc that includes a disc hole for each of the individual sections, and upon rotation of the wheel to align the disc hole with the outlet of the dispense knobs, the selected sections are able to dispense a single vitamin simultaneously into a funnel that collects the dispensed vitamins into a pull out drawer. The canister includes a calendar member to keep track of the previous time of use.

It is an object of the invention to provide a dispensing machine that is specially designed for dispensing one of a plurality of different vitamins.

A further object of the invention is to provide a single dispensing machine that includes a plurality of individual sections that are selectively engaged in order to individually dispense a single vitamin or multiple vitamins at a time.

A further object of the invention is to provide a canister that is transparent so as to enable visual confirmation of the desired vitamin to be dispensed prior to dispensing.

These together with additional objects, features and advantages of the vitamin dispensing machine will be readily apparent to those of ordinary skill in the art upon reading the following detailed description of presently preferred, but nonetheless illustrative, embodiments of the vitamin dispensing machine when taken in conjunction with the accompanying drawings.

In this respect, before explaining the current embodiments of the vitamin dispensing machine in detail, it is to be understood that the vitamin dispensing machine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the vitamin dispensing machine.

It is therefore important that the claims be regarded as including such equivalent construction insofar as they do not depart from the spirit and scope of the vitamin dispensing machine. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
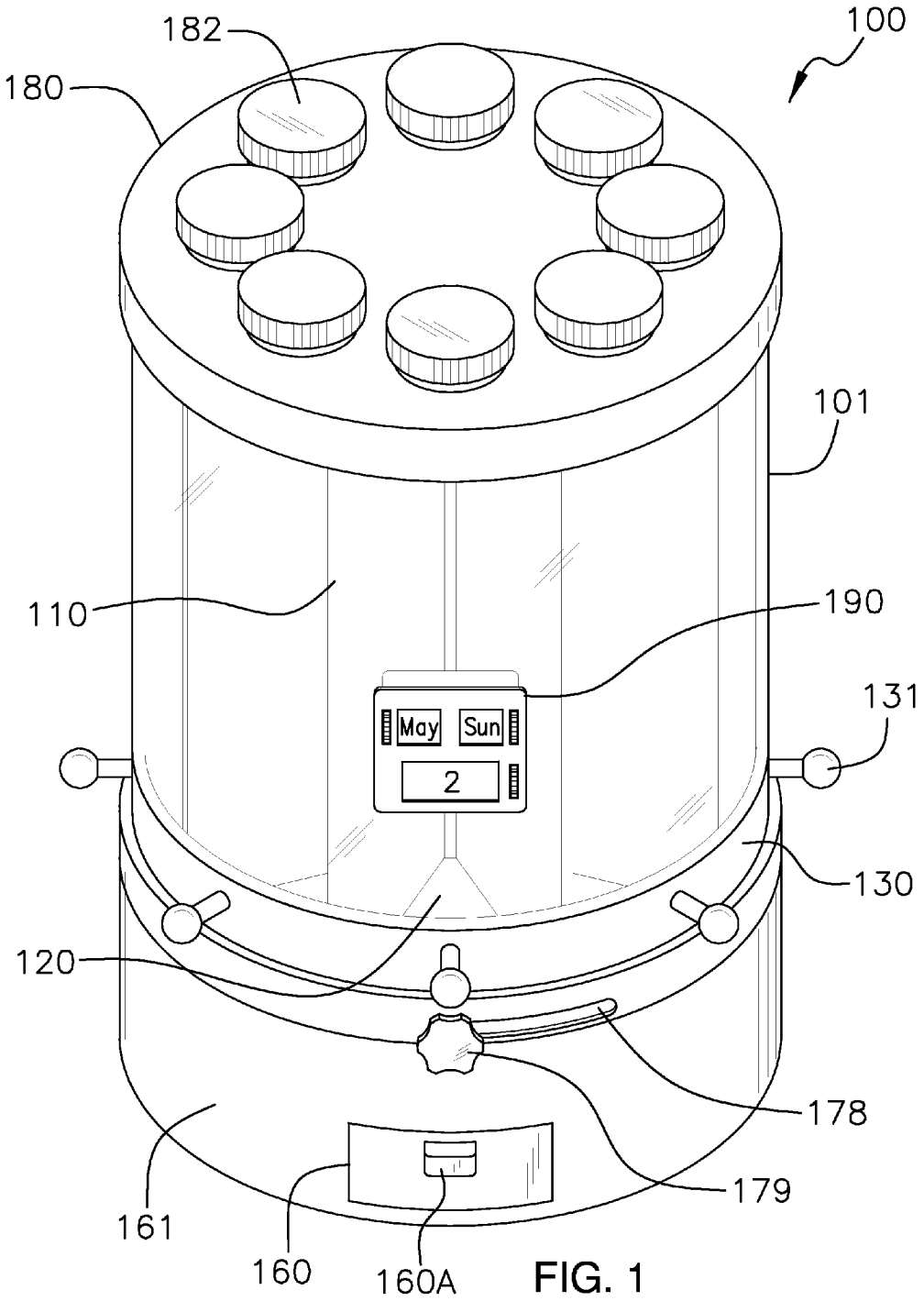
FIG. 1 illustrates a perspective view of the vitamin dispensing machine.
Figure 2:
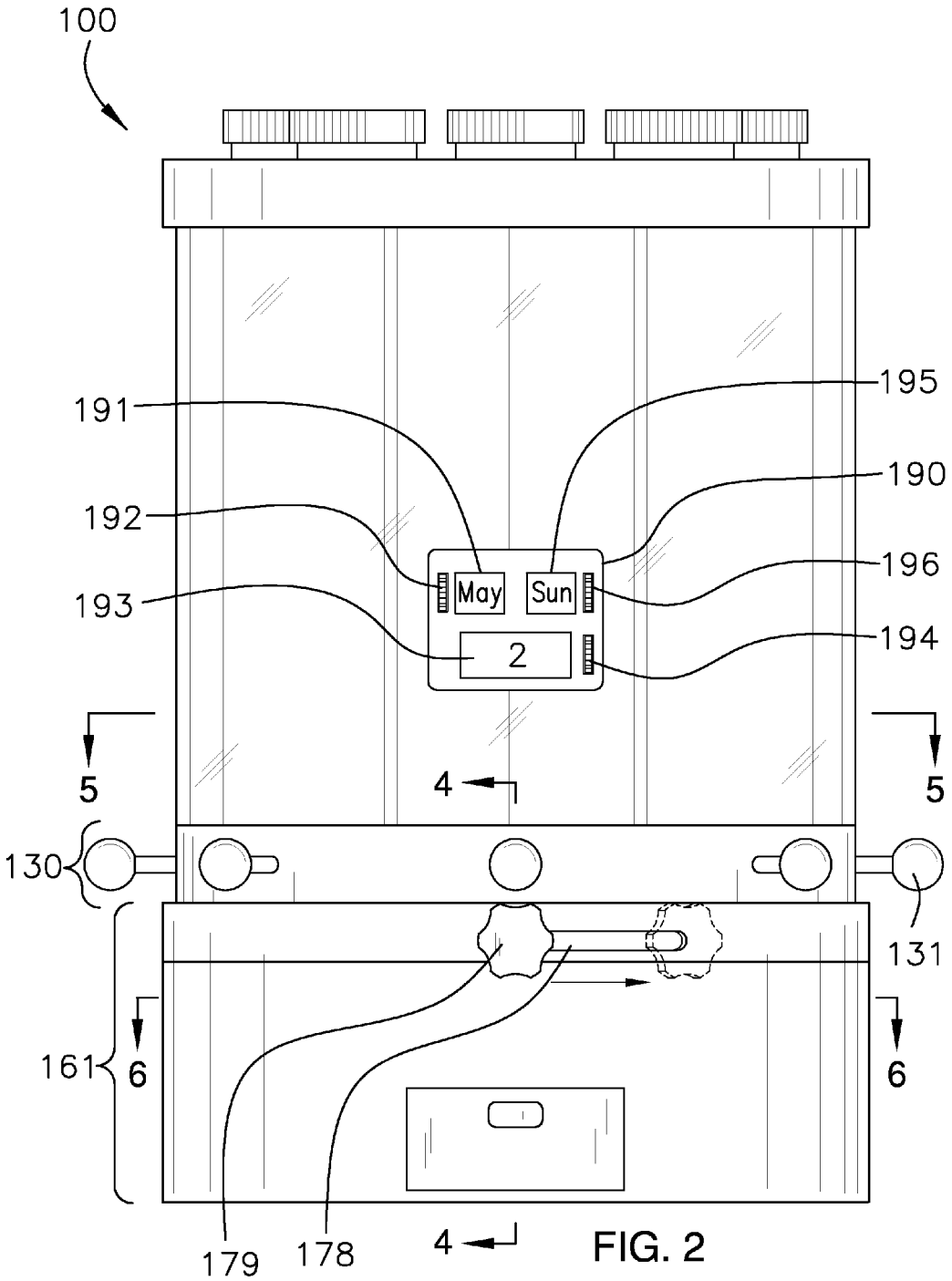
FIG. 2 illustrates a front view of the vitamin dispensing machine.
Figure 3:
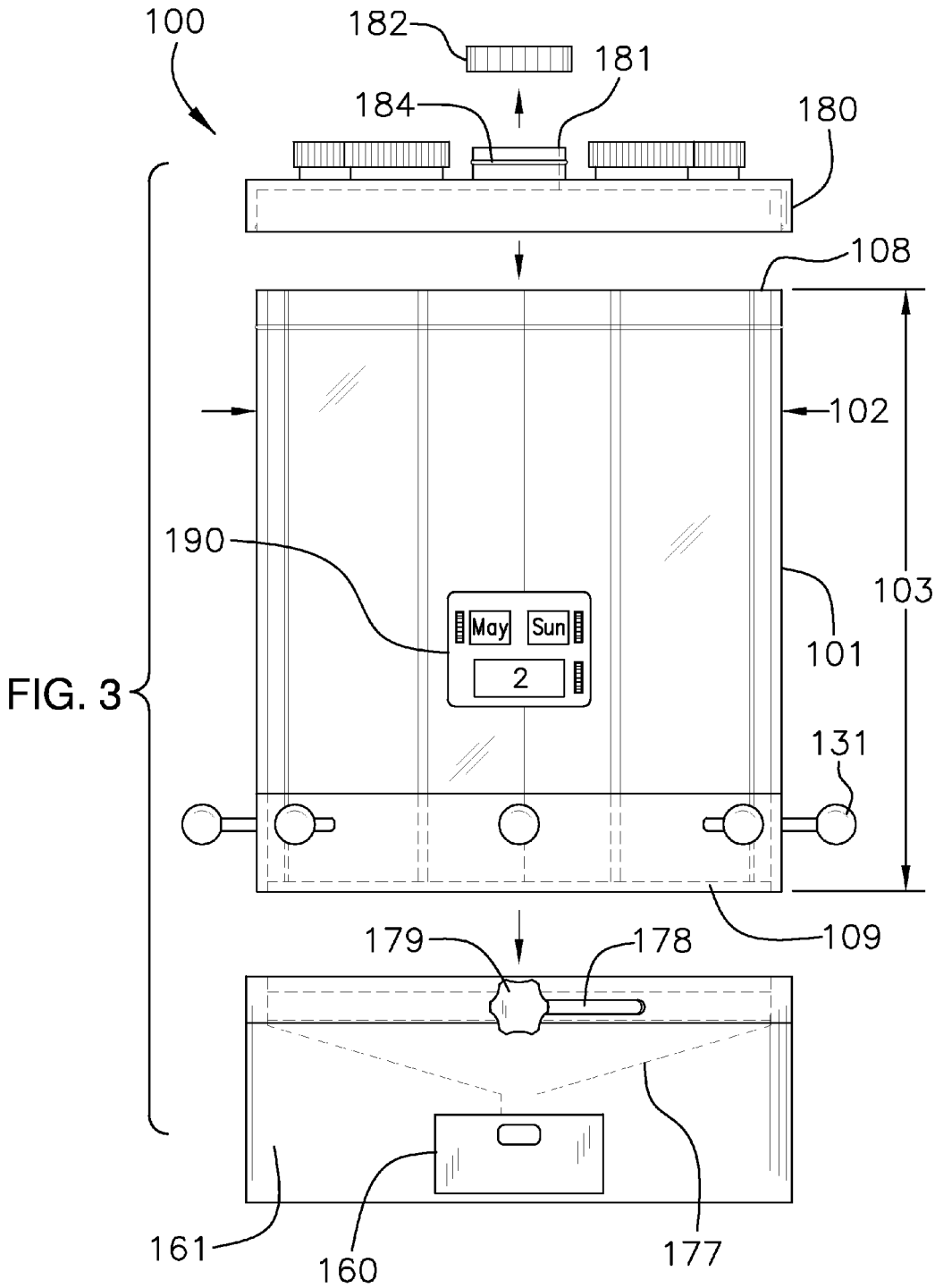
FIG. 3 illustrates an exploded view of the vitamin dispensing machine.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A vitamin dispensing machine 100 (hereinafter invention) is further defined with a canister 101 that has a canister diameter 102 and a canister height 103. The canister 101 is of hollowed construction and includes partition members 110 inside of the canister 101, which divides the interior of the canister 101 into individual sections 120. The individual sections 120 are designed to store a plurality of a selected vitamin 200. As a side note, it shall be duly pointed out that the invention 100 may be used with vitamins 200 and/or pill-shaped objects. More the point, the invention 100 is adapted to store a plurality of different vitamins 200 and/or pill-shaped objects via the plurality of individual sections 120.

The individual sections 120 are longitudinally oriented, are parallel with one another, and form a slice of the overall area of the canister 101. The canister 101 is made of a transparent material so that an end user can make visual contact with the contents of the canister 101. The canister 101 is also further defined with a top edge 108 that opens up to the partitions 110 and individual sections 120 therein. The canister 101 is further defined with a dispensing portion 130, which is located adjacent a bottom surface 109 of the canister 101. The dispensing portion 130 includes a plurality of dispense knobs 131 that are each aligned to one of the individual sections 120.

Figure 4:
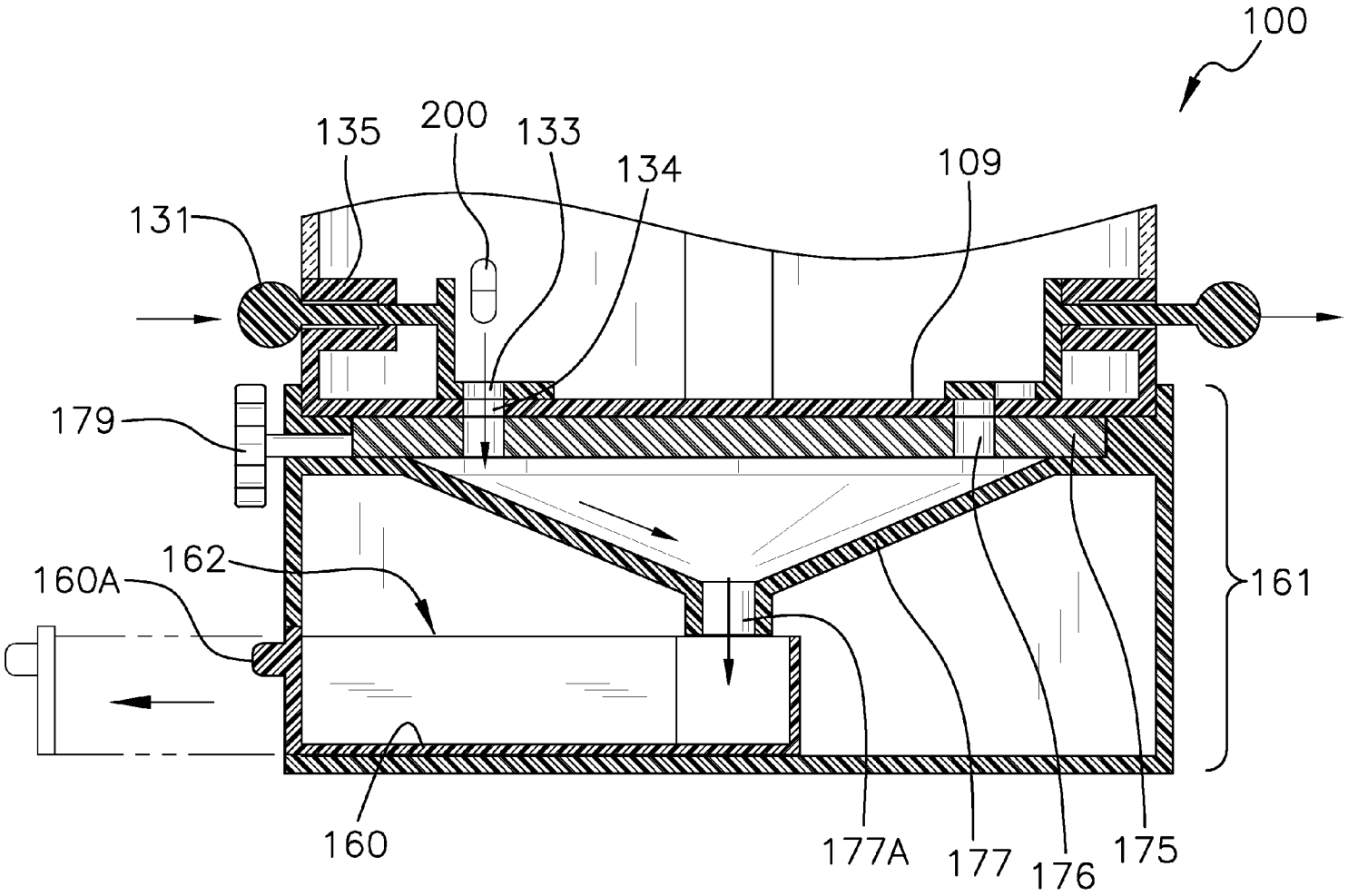
FIG. 4 illustrates a partial cross-sectional view along line 4-4 in FIG. 2 of the vitamin dispensing machine.
Figure 5:
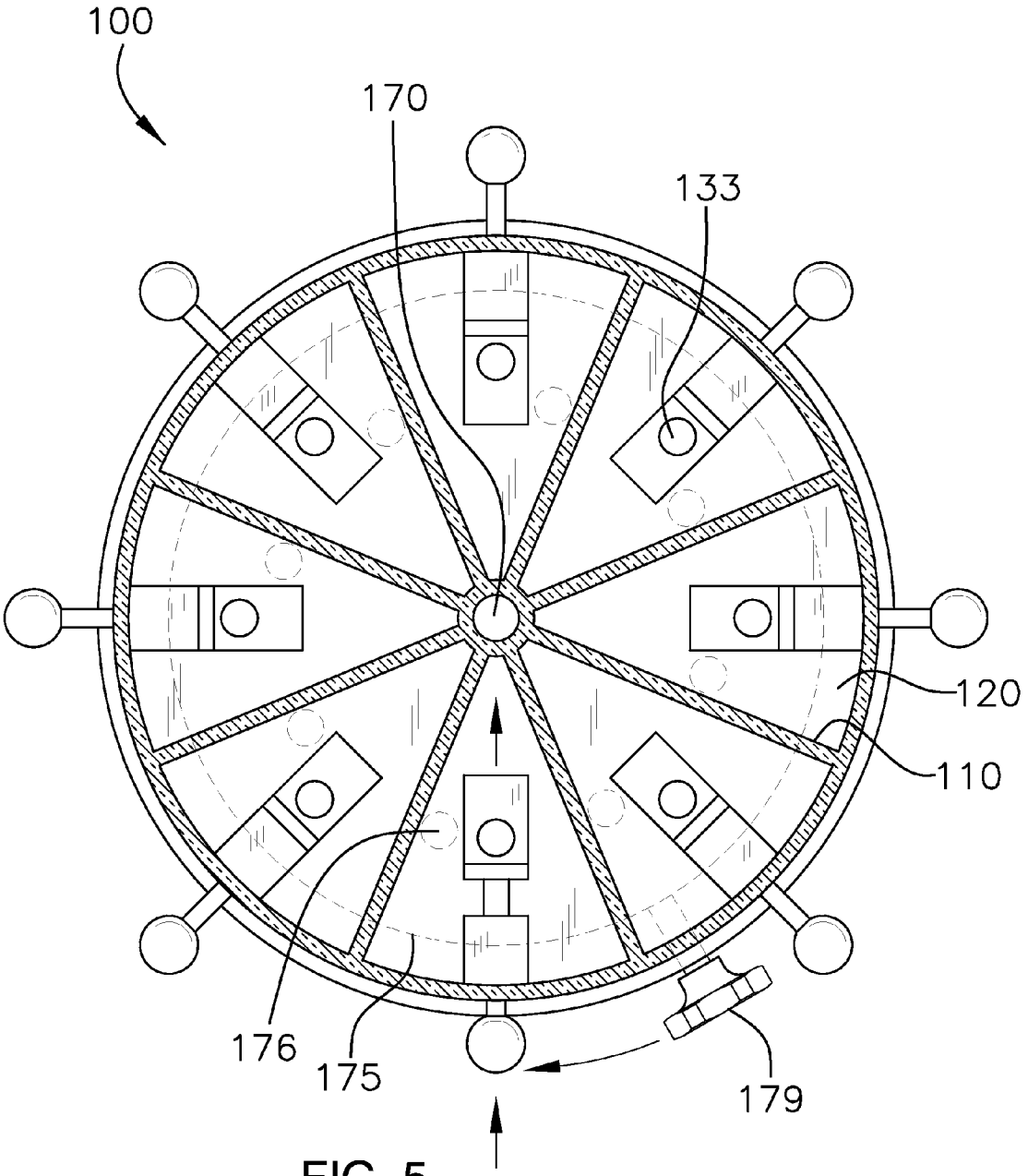
FIG. 5 illustrates a cross-sectional view along line 5-5 in FIG. 2.
Figure 6:
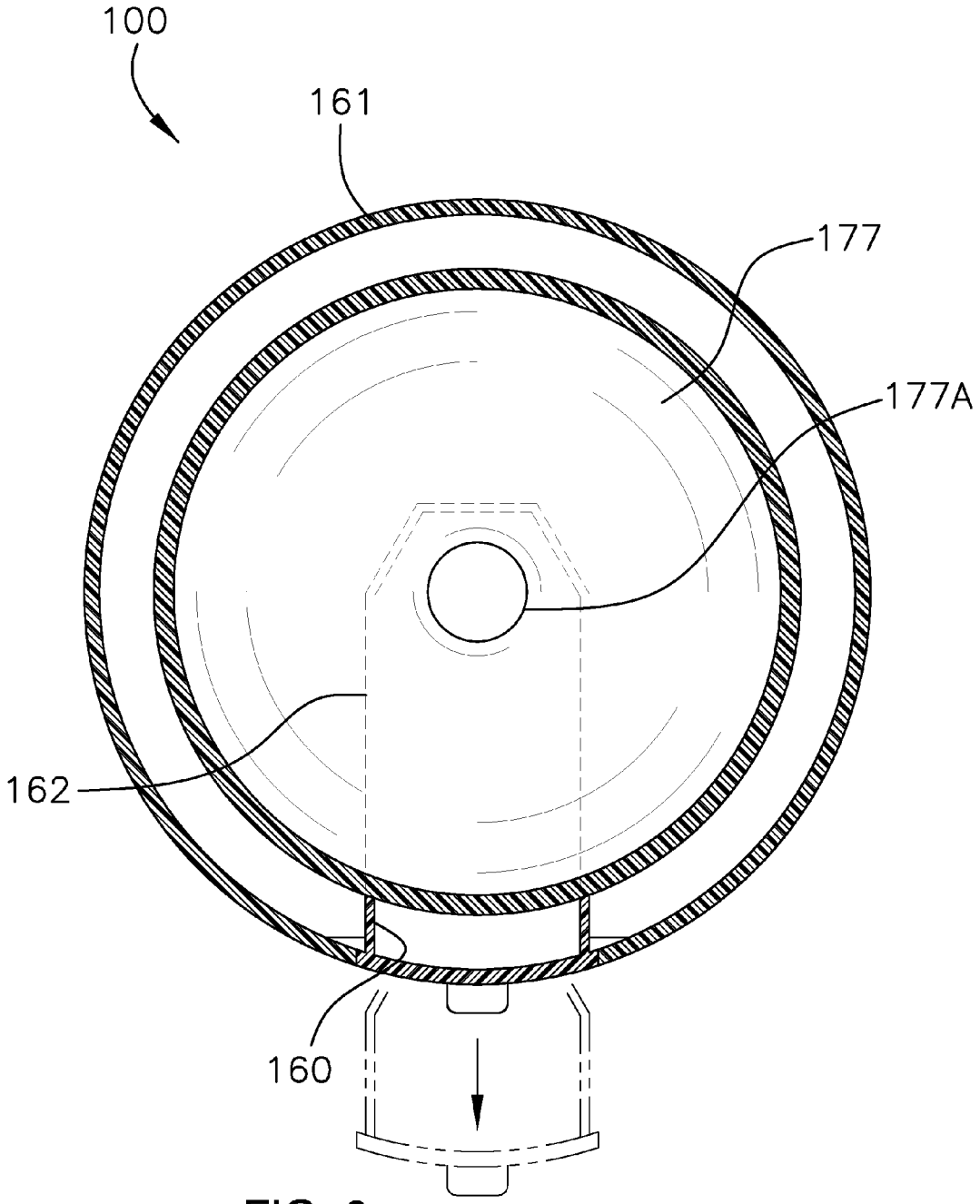
FIG. 6 illustrates a cross-sectional view along line 6-6 in FIG. 2.

Referring to FIG. 4, the dispense knobs 131 are each able to be pushed inwardly in order to align a dispense hole 133 with a canister hole 134. The canister hole 134 is located on the bottom surface 109 of the canister 101. The dispense hole 133 moves with respect to the dispense knob 131. The dispense knob 131 is supported and able to move with respect to a dispense knob compartment 135. Only upon pushing the dispense knob 131 inwardly shall alignment of the canister hole 134 and the dispense hole 133 enable a single vitamin 200 to exit from the individual section 120 and towards a rotating disc 175 that is provided underneath the canister 101. The rotating disc 175 includes a plurality of rotating disc holes 176 that align with the canister holes 134 to enable vitamins 200 to descend onto a funnel 177 located there under. The rotating disc 175 is manipulated via a rotating disc knob 179 that is able to rotate back and forth within a knob slot 178 provided on a base 161. A drawer member 160 is integrated into the base 161, and is positioned below the funnel 177 in order to enable all of the designated vitamins 200 to collect therein.

It shall be noted that it requires the dispense hole 133 to be aligned with the canister hole 134 of any of the individual sections 120, and then rotation of the rotating disc knob 179 via the knob slot 178 before any vitamins 200 are dispensed onto the funnel 177. Moreover, the funnel 177 includes a funnel hole 177A that is directly over top of the drawer 161. The drawer 160 may include a drawer handle 160A to enable insertion and removal with respect to the base 161. The drawer member 160 is able to slide in and out of a drawer compartment 162 integrated into the base 161. The canister 101 is situated on the base 161.

The invention 100 includes a snap on lid 180 that is able to clip on to the top edge 108 of the canister 101. Moreover, the snap on lid 180 includes a plurality of ports 181 that are aligned with respect to the individual sections 120 of the canister 101. The snap on lid 180 includes a plurality of snap on caps 182 that screw onto each of the ports 181 so that the individual sections 120 may be refilled as needed without having to remove the snap on lid 180 and expose all individual sections. Moreover, the ports 181 each include a ribbed protuberance 184 that secures the snap on caps 182 thereto.

The invention 100 also includes a calendar 190 that is located on the canister 101. The calendar 190 includes a month box 191 with a month dial 192, a day box 193 with a day dial 194, and a day of week box 195 and day of week dial 196. The calendar 190 is a means of reminding an end user as to the last date of use of the invention 100.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A vitamin dispensing machine comprising:

a canister rotably engaged atop a base;

wherein the canister includes a plurality of individual sections configured to store a plurality of a selected vitamin or pill-shaped object;

wherein each individual section includes a dispense knob that is able to individually dispense a single vitamin or pill-shaped object into a drawer member located in said base;

wherein the canister has a canister diameter and a canister height; wherein the canister is of hollowed construction and includes partition members inside of the canister, which divides the interior of the canister into the individual sections;

wherein the individual sections are longitudinally oriented, are parallel with one another, and form a slice of the overall area of the canister; wherein the canister is made of a transparent material; wherein the canister is also further defined with a top edge that opens up to the partitions and individual sections therein; wherein the canister is further defined with a dispensing portion, which is located adjacent a bottom surface of the canister;

wherein the dispensing portion includes a plurality of the dispense knobs that are each aligned to one of the individual sections; wherein the dispense knobs are each able to be pushed inwardly in order to align a dispense hole with a canister hole; wherein the canister hole is located on the bottom surface of the canister; wherein the dispense hole moves with respect to the dispense knob;

wherein the dispense knobs are each able to be pushed inwardly in order to align a dispense hole with a canister hole; wherein the canister hole is located on the bottom surface of the canister; wherein the dispense hole moves with respect to the dispense knob; wherein the dispense knob is supported and able to move with respect to a dispense knob compartment; wherein only upon pushing the dispense knob inwardly shall alignment of the canister hole and the dispense hole enable a single vitamin to exit from the individual section and towards a rotating disc that is provided underneath the canister;

wherein the rotating disc includes a plurality of rotating disc holes that align with the canister holes to enable vitamins to descend onto a funnel located there under;

wherein the rotating disc is manipulated via a rotating disc knob that is able to rotate back and forth within a knob slot provided on a base.

2. The vitamin dispensing machine as described in claim 1 wherein a drawer member is integrated into the base, and is positioned below the funnel in order to enable all of the designated vitamins to collect therein.

3. The vitamin dispensing machine as described in claim 2 wherein it is a requirement for the dispense hole to be aligned with the canister hole of any of the individual sections, and then rotation of the rotating disc knob via the knob slot before any vitamins are dispensed onto the funnel; wherein the funnel includes a funnel hole that is directly over top of the drawer; wherein the drawer includes a drawer handle to enable insertion and removal with respect to the base; wherein the drawer member is able to slide in and out of a drawer compartment integrated into the base; wherein the canister is situated on the base.

4. The vitamin dispensing machine as described in claim 3 wherein a snap on lid is able to clip on to the top edge of the canister; wherein the snap on lid includes a plurality of ports that are aligned with respect to the individual sections of the canister; wherein the snap on lid includes a plurality of snap on caps that screw onto each of the ports so that the individual sections may be refilled as needed without having to remove the snap on lid and expose all individual sections; wherein the ports each include a ribbed protuberance that secures the snap on caps thereto.

5. The vitamin dispensing machine as described in claim 4 wherein a calendar is located on the canister; wherein the calendar includes a month box with a month dial that rotates to select a particular month; wherein the calendar includes a day box with a day dial that rotates to select a particular day of the month; wherein the calendar includes a day of week box and day of week dial that rotates to select a particular day of the week.

6. A vitamin dispensing machine comprising:

a canister rotably engaged atop a base;

wherein the canister includes a plurality of individual sections configured to store a plurality of a selected vitamin or pill-shaped object;

wherein each individual section includes a dispense knob that is able to individually dispense a single vitamin or pill-shaped object into a drawer member located in said base;

wherein the canister has a canister diameter and a canister height; wherein the canister is of hollowed construction and includes partition members inside of the canister, which divides the interior of the canister into the individual sections;

wherein the individual sections are longitudinally oriented, are parallel with one another, and form a slice of the overall area of the canister; wherein the canister is made of a transparent material; wherein the canister is also further defined with a top edge that opens up to the partitions and individual sections therein; wherein the canister is further defined with a dispensing portion, which is located adjacent a bottom surface of the canister;

wherein a calendar is located on the canister; wherein the calendar includes a month box with a month dial that rotates to select a particular month; wherein the calendar includes a day box with a day dial that rotates to select a particular day of the month; wherein the calendar includes a day of week box and day of week dial that rotates to select a particular day of the week;

wherein the dispensing portion includes a plurality of the dispense knobs that are each aligned to one of the individual sections; wherein the dispense knobs are each able to be pushed inwardly in order to align a dispense hole with a canister hole; wherein the canister hole is located on the bottom surface of the canister; wherein the dispense hole moves with respect to the dispense knob;

wherein the dispense knobs are each able to be pushed inwardly in order to align a dispense hole with a canister hole; wherein the canister hole is located on the bottom surface of the canister; wherein the dispense hole moves with respect to the dispense knob; wherein the dispense knob is supported and able to move with respect to a dispense knob compartment; wherein only upon pushing the dispense knob inwardly shall alignment of the canister hole and the dispense hole enable a single vitamin to exit from the individual section and towards a rotating disc that is provided underneath the canister;

wherein the rotating disc includes a plurality of rotating disc holes that align with the canister holes to enable vitamins to descend onto a funnel located there under.

7. The vitamin dispensing machine as described in claim 6 wherein the rotating disc is manipulated via a rotating disc knob that is able to rotate back and forth within a knob slot provided on a base.

8. The vitamin dispensing machine as described in claim 7 wherein a drawer member is integrated into the base, and is positioned below the funnel in order to enable all of the designated vitamins to collect therein.

9. The vitamin dispensing machine as described in claim 8 wherein it is a requirement for the dispense hole to be aligned with the canister hole of any of the individual sections, and then rotation of the rotating disc knob via the knob slot before any vitamins are dispensed onto the funnel; wherein the funnel includes a funnel hole that is directly over top of the drawer; wherein the drawer includes a drawer handle to enable insertion and removal with respect to the base; wherein the drawer member is able to slide in and out of a drawer compartment integrated into the base; wherein the canister is situated on the base.

10. The vitamin dispensing machine as described in claim 9 wherein a snap on lid is able to clip on to the top edge of the canister; wherein the snap on lid includes a plurality of ports that are aligned with respect to the individual sections of the canister; wherein the snap on lid includes a plurality of snap on caps that screw onto each of the ports so that the individual sections may be refilled as needed without having to remove the snap on lid and expose all individual sections; wherein the ports each include a ribbed protuberance that secures the snap on caps thereto.

* * * * *